United States Patent [19]

Nordh

[11] Patent Number: 4,748,916

[45] Date of Patent: Jun. 7, 1988

[54] CAST AIR NOZZLE

[75] Inventor: Hans L. Nordh, Gothenburg, Sweden

[73] Assignee: Gotaverken Energy AB, Gothenburg, Sweden

[21] Appl. No.: 98,887

[22] Filed: Sep. 21, 1987

[30] Foreign Application Priority Data

Sep. 30, 1986 [SE] Sweden ..... 8604132

[51] Int. Cl.[4] ..... F23L 5/00

[52] U.S. Cl. ..... 110/182.5; 110/245; 122/4 D; 122/6.6; 145/104.16; 239/548; 239/568; 431/7; 431/170

[58] Field of Search ..... 110/182.5, 310, 311, 110/245, 313; 122/4 D, 6.6; 431/7, 170; 165/104.16; 34/57 B; 239/548, 565, 567, 568

[56] References Cited

U.S. PATENT DOCUMENTS 873,624 12/1907 Springer et al. ..... 239/568 X
4,628,831 12/1986 Delessard et al. ..... 110/245
4,656,971 4/1986 Eaton et al. ..... 110/245 X

FOREIGN PATENT DOCUMENTS 999046 9/1951 France ..... 239/568

*Primary Examiner*—Edward G. Favors
*Attorney, Agent, or Firm*—Brooks & Kushman

[57] ABSTRACT

A cast air nozzle is adapted to be mounted on the bottom of a combustor, particularly a fluidized-bed combustor. The air nozzle comprises a substantially gun-shaped body having a substantially horizontal upper part with a front portion and a rear portion, and a substantially vertical lower part with a through, substantially vertical inlet duct, two substantially horizontal outlet ducts in the upper part extending from the upper end of the inlet duct and opening at the front end of the front portion. The outlet ducts diverge towards the front end of the front portion, whereby an air current flowing through the air nozzle is caused to leave the nozzle in the form of horizontal diverging air jets. The upper part has at the front portion a horizontal planar upper surface and at the rear portion a backwardly-downwardly inclined upper surface, said surfaces forming an angle with each other, whereby the material in the combustor, which is conveyed across the air nozzle, does not collect on the upper portion. Each outlet duct tapers towards its orifice so as to prevent the material in the combustor from being conducted into the air nozzle and causing clogging thereof, or the bed material from flowing back.

7 Claims, 3 Drawing Sheets

CAST AIR NOZZLE

The present invention relates to a cast air nozzle which is adapted to be mounted on the bottom of a combustor, particularly a fluidised-bed combustor, and comprises a substantially gun-shaped body having a substantially horizontal upper part with a front portion and a rear portion, and a substantially vertical lower part with a through, substantially vertical inlet duct, two substantially horizontal outlet ducts in the upper part extending from the upper end of the inlet duct and opening at the front end of the front portion.

Because of the severe environmental conditions in connection with fluidised-bed combustors, heavy demands are placed on the air nozzles used therein, with regard to both durability and function.

The air nozzles presently used in fluidised-bed combustors for introducing the fluidising air which is necessary for combustion, are of different types, but they all have in common that they suffer from various shortcomings which make them less suited for the purpose, particularly in fluidised-bed combustors for refuse incineration. Since refuse contains more clogging, corroding and eroding substances than other solid fuels, the risk that the air nozzles are clogged, eroded or corroded, is especially great in connection with refuse incineration.

The air nozzle types now used in the above-mentioned contexts are, inter alia, T nozzles which are readily manufactured but have a strong tendency to erode and corrode, and mushroom nozzles which prevent coarse particles from moving along the bottom of the bed and therefore require frequent cleaning, which involves high additional costs.

A further drawback of the above-mentioned nozzles is that they are difficult to replace. In contrast to the air nozzle according to the present invention, the air nozzles above furthermore are not cast.

U.S. Pat. No. 2,608,169 discloses an air nozzle to be used in a normal refuse burner, which, like the air nozzle according to the invention, is cast. Moreover, it has a central inlet duct extending vertically and a plurality of radially disposed outlet ducts. Despite the similarities to the air nozzle according to the present invention, this nozzle could not be used in a fluidised-bed combustor since it directs the air flow downwardly to the bottom of the burner and therefore cannot fluidise the bed of the fluidised-bed combustor.

One object of the present invention is to provide a cast air nozzle having a simple and durable design from the point of view of, inter alia, erosion and corrosion, which makes manufacture less expensive and results in a long life.

Another object of the invention is to provide a cast air nozzle which is readily replaced and cleaned.

A still further object of the invention is to provide a cast air nozzle which supplies the bed with air in such a manner that a coarse material is moved along the bottom of the bed.

These and further objects of the invention are achieved in that the cast air nozzle of the type mentioned by way of introduction has the characteristic features in the appended main claim. The subclaims define particularly preferred embodiments of the invention.

The invention will now be described in detail below, reference being had to the accompanying drawings in which.

The terms "horizontal" and "vertical" and, respectively, "front" and "rear" are used in the description below and in the claims with reference to the Figures, i.e. with regard to the position of the air nozzle when mounted in a combustor.

Figure 1:
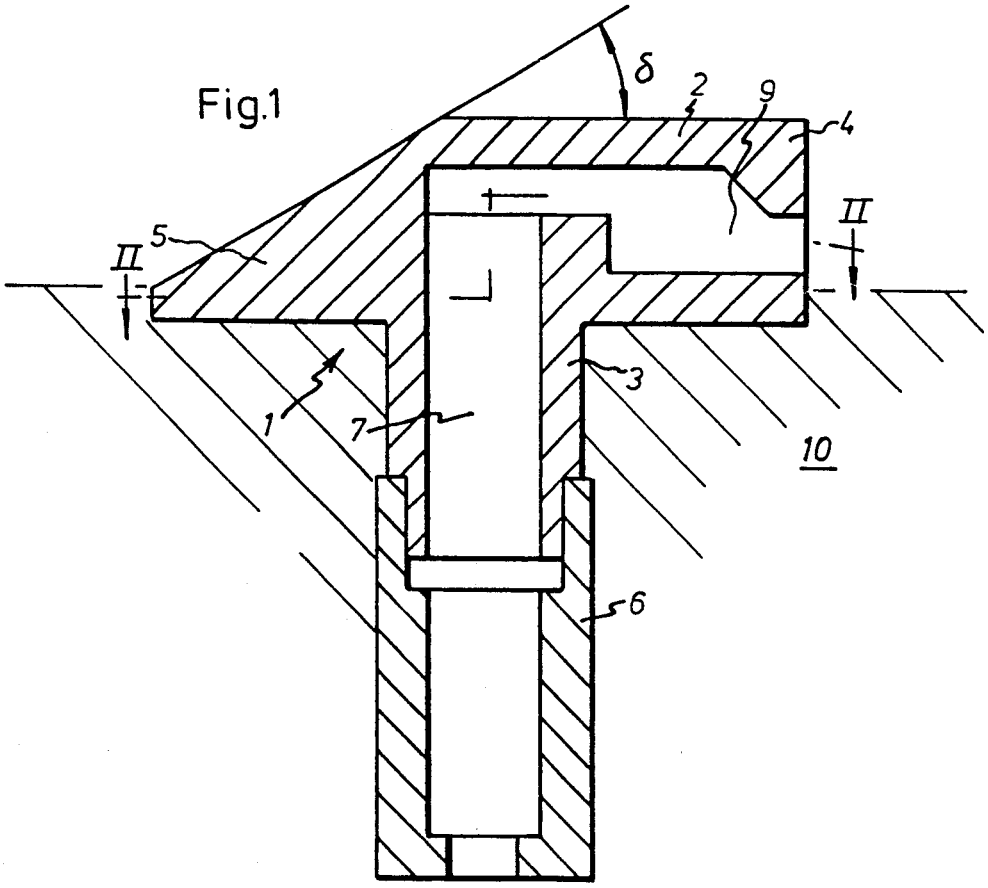
FIG. 1 is a longitudinal section of a cast air nozzle according to the present invention.

The cast air nozzle shown in FIG. 1 comprises a substantially gun-shaped body 1 formed in one piece and having a substantially horizontal upper part 2 with a front portion 4 and a rear portion 5, and a substantially vertical lower part 3 in the form of a sleeve.

As appears from FIG. 1, the free end of the lower part 3 is adapted to be inserted in a throttle sleeve 6 and therefore has a smaller outer diameter than the remaining sleeve-shaped part, said outer diameter conforming to the inner diameter of the upper part of the internally stepped throttle sleeve 6. The cast air nozzle is via the throttle sleeve 6 further connected with a chamber (not shown) which is supplied with fluidising air.

The cast air nozzle also comprises a central, substantially vertical inlet duct 7 and two substantially horizontal outlet ducts 8, 9 arranged in the upper part 2. The inlet duct 7 opens in the free end of the lower part 3 and extends to a point immediately below the upper boundary surface of the upper part 2. The outlet ducts 8, 9 extend from the upper end of inlet duct 7 and open at the front end of the front portion 4.

Moreover, it appears from FIG. 1 that the front portion 4 of the upper part 2 has a rectangular longitudinal section, whereas the rear portion 5 has a substantially triangular longitudinal section. This means that the front portion 4 obtains a horizontal planar upper surface, whereas the rear portion 5 obtains a backwardly-downwardly inclined planar upper surface, said surfaces forming an angle $\delta$ with each other, whereby the material in the combustor, which is conveyed across the air nozzle, does not collect on the upper part 2. The angle $\delta$ between said upper surfaces is 15°–45°, preferably 30°.

Figure 3:
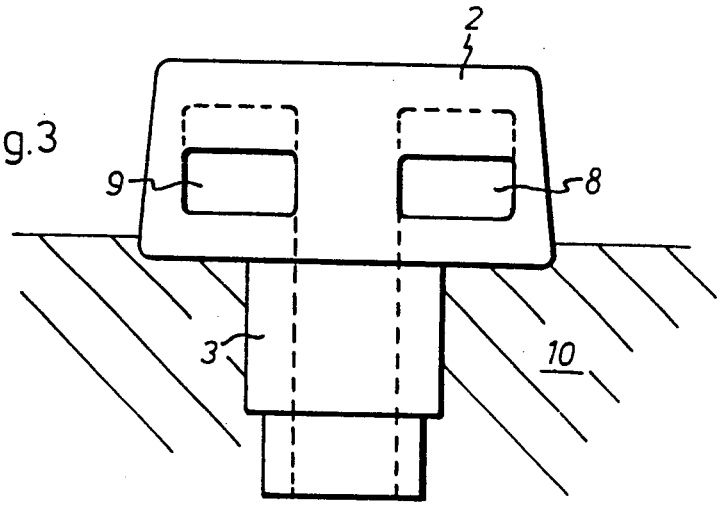
FIG. 3 is an end view of the air nozzle in FIG. 1.

Furthermore, the air nozzle is fixedly mounted on a base 10 which in this case is the bottom of a fluidised-bed combustor (not shown). To prevent the material (sand, scrap/in connection with refuse incineration/, stones etc.) inside the fluidised-bed combustor from entering the air nozzle and thus cause clogging thereof or the bed material from flowing back, the outlet ducts 8, 9, have a decreasing height towards the orifice, as shown in FIGS. 1 and 3. This implies also that the material thickness of the air nozzle is extra large at the orifices, which is an advantage as regards erosion, since the air nozzle is subjected to particularly severe erosion around the orifices of the outlets.

Figure 2:
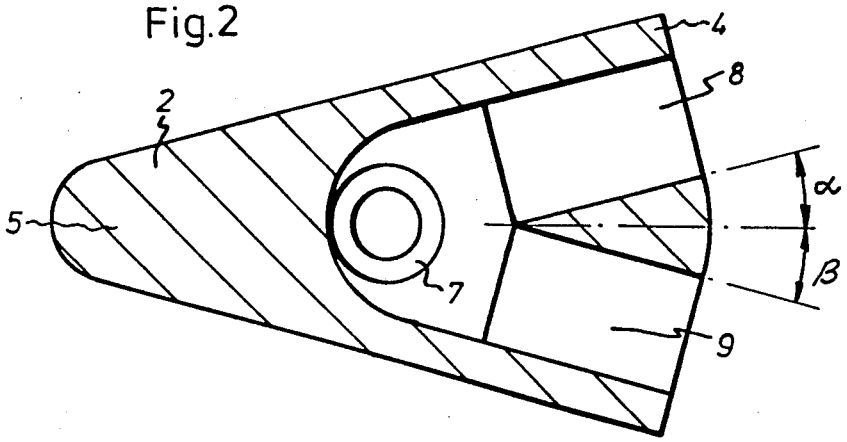
FIG. 2 is a cross-section along line II—II in FIG. 1.

It appears from FIG. 2 that the upper part 2 has rearwardly converging sides, which contributes to preventing the material conveyed across the air nozzle from collecting on the upper part, and that the outlet ducts 8, 9 are disposed on both sides of the cast air nozzle symmetry plane which corresponds to the longitudinal vertical centre plane thereof, and form an angle 60 and $\beta$, respectively, therewith. The angles $\alpha$ and $\beta$ can be equal or unequal in size and vary from 0° to 90°, but are preferably of the same size and 10°–30°, preferably 15°.

Figure 4:
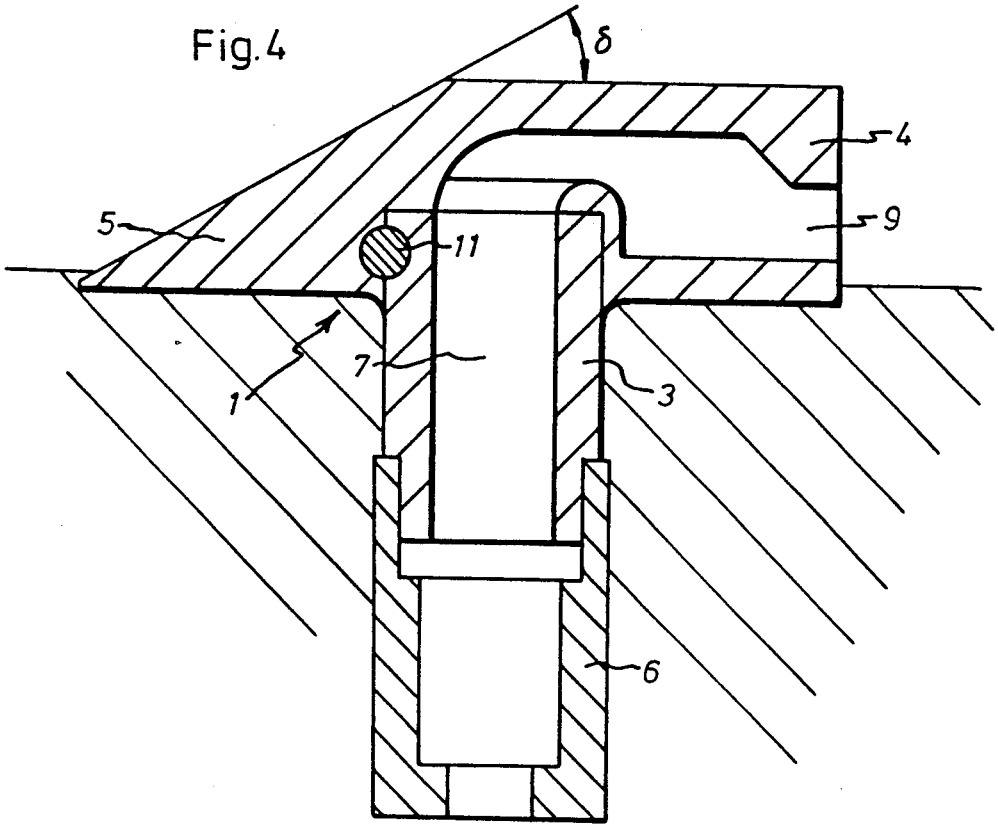
FIG. 4 is a longitudinal section of a variant of the cast air nozzle in FIGS. 1–3.

FIG. 4 shows a variant of the cast air nozzle in FIGS. 1–3, the body of the air nozzle not being formed in one piece, but instead consisting of two separate parts 2, 3 which are releasably interconnected by means of a pin 11 extending through holes made in said parts. Forming the air nozzle body in two separate parts brings the advantage that the air nozzle need not be dismantled from the bottom of the combustor to facilitate replacing the upper part 2 which is subjected to erosion and corrosion.

Figure 5:
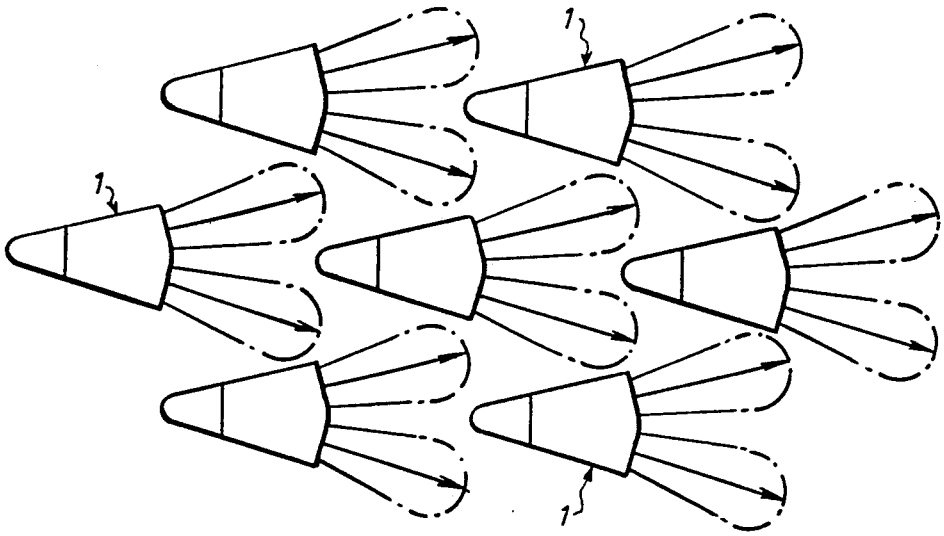
FIG. 5 illustrates schematically an example of how a plurality of cast air nozzles according to the present invention can be mounted on the bottom of a fluidised-bed combustor.

The number of air nozzles which are disposed on the bottom of the combustor depends on the effect and size of the combustor, and FIG. 5 shows how they may be mounted. This Figure also shows that the fluidising air which is supplied to the cast air nozzles via the chamber (not shown) leaves the air nozzles in the form of horizontal diverging air jets. The air jets are directed such that the air nozzles do not blow air on each other, whereby the risk of corrosion and erosion damage to the upper part 2 is greatly reduced, at the same time as they cause the air to be widely distributed, which results in adequate fluidising of the entire bed.

Owing to its simple design, the air nozzle according to the present invention can be mass-produced at a relatively low cost and readily cleaned from undesired material and can be manufactured from non-weldable material, which means that also ceramic material can be used.

It will be appreciated that the invention is not restricted to the embodiments shown, but can be modified in several ways within the scope of the appended claims.

What I claim and desire to secure by Letters Patent is:

1. A cast air nozzle which is adapted to be mounted on the bottom of a combustor, particularly a fluidised-bed combustor, and comprises a substantially gun-shaped body having a substantially horizontal upper part with a front portion and a rear portion, and a substantially vertical lower part with a through, substantially vertical inlet duct, two substantially horizontal outlet ducts in the upper part extending from the upper end of the inlet duct and opening at the front end of the front portion, characterised in that the outlet ducts diverge towards the front end of the front portion, whereby an air current flowing through the air nozzle is caused to leave the nozzle in the form of horizontal diverging air jets, that the upper part has at the front portion a horizontal planar upper surface and at the rear portion a backwardly-downwardly inclined upper surface, said surfaces forming an angle with each other, whereby the material in the combustor, which is conveyed across the air nozzle, does not collect on the upper part, and that each outlet duct tapers towards its orifice so as to prevent the material in the combustor from being conducted into the air nozzle and causing clogging thereof, or the bed material from flowing back.

2. A cast air nozzle as claimed in claim 1, characterised in that the upper part has rearwardly converging sides, which contributes to preventing the material conveyed across the air nozzle, from collecting on the upper part.

3. A cast air nozzle as claimed in claim 1 or 2, charcterised in that the angle between the outlet ducts is 20°–60°, preferably 30°.

4. A cast air nozzle as claimed in claim 1, characterised in that the angle between said upper surfaces is 15°–45°, perferably 30°.

5. A cast air nozzle as claimed in claim 1, characterised in that the body is formed in one piece.

6. A cast air nozzle as claimed in claim 1, characterised in that the body consists of two separate parts which are releasable interconnected by a connecting means.

7. A cast iar nozzle as claimed in claim 6, characterised in that the connecting means is a pin.

* * * * *